United States Patent [19]

Lee

[11] 3,967,007

[45] June 29, 1976

[54] METHOD FOR PRODUCING DISTRESSED WOOD

[75] Inventor: Hong Man Lee, White Plains, N.Y.

[73] Assignee: Champion International Corporation, Stamford, Conn.

[22] Filed: Nov. 6, 1974

[21] Appl. No.: 521,252

[52] U.S. Cl. ..... 427/223; 427/274; 427/275; 427/291; 427/308; 427/317; 427/368; 427/377; 427/444

[51] Int. Cl.[2] ..... B05D 3/08

[58] Field of Search ..... 427/368, 317, 377, 273, 427/274, 275, 223, 226, 308, 289, 291, 227, 444

[56] References Cited

UNITED STATES PATENTS 1,574,662 2/1926 Leedom ..... 427/223

3,081,159 3/1963 Brown ..... 427/368

*Primary Examiner*—Harry J. Gwinnell
*Assistant Examiner*—Janyce A. Bell
*Attorney, Agent, or Firm*—Evelyn M. Sommer

[57] ABSTRACT

Particles of metallic sodium or potassium are placed on a wood substrate which has been pre-heated. When the wood substrate is introduced subsequently into a steam zone the sodium or potassium, as the case may be, reacts exothermally with the water vapor, melts and burns, charring the wood in localized regions. The particles of sodium or potassium are confined by grains of sand which are subsequently brushed away with any loose charcoal to produce a distressed surface to the wood.

9 Claims, 4 Drawing Figures

METHOD FOR PRODUCING DISTRESSED WOOD

The present invention relates to the production of distressed wood and, more particularly, to a method for accomplishing the distressing thereof.

For decorative purposes, marks or "blemishes" are often formed deliberately in the surface of wood panels, lumber, or the like, tending to give the impression of age, for use in building construction and furniture manufacture. Various methods have been employed heretofore for this purpose. For example, various tools have been applied to the surface of a wood substrate to create holes, recesses, gouges or other "imperfections" in the surface thereof. Another method utilizes the principle that springwood chars more readily than summerwood. Thus, wood panels have been distressed by passing beneath a gas flame at an appropriate rate to char the springwood but not the summerwood. Subsequent rigorous brushing scrapes away the charred springwood leaving irregular grooves in the surface of the wood. However, the grooves are confined to the springwood and depend upon the particular grain of the wood involved.

It is an object of the present invention to provide a method for distressing the surface of wood independent of the relation between the springwood and summerwood.

It is a further object of the present invention to provide a simple and economic procedure for distressing wood paneling or lumber.

In accordance with the present invention, there is provided a method of distressing wood which comprises the steps of distributing over a surface of a wood substrate a quantity of particles selected from the group consisting of metallic sodium and metallic potassium, inducing spontaneous combustion in said particles, and thereafter cleansing said surface to remove burned residues and loose charcoal. As will appear hereinafter, the subject method produces irregular distress marks in the surface of the wood which are not confined to the springwood thereof but develop randomly independent of the wood grain.

The invention will be better understood after reading the following detailed description of the presently preferred embodiments thereof with reference to the appended drawings in which.

Figure 2:
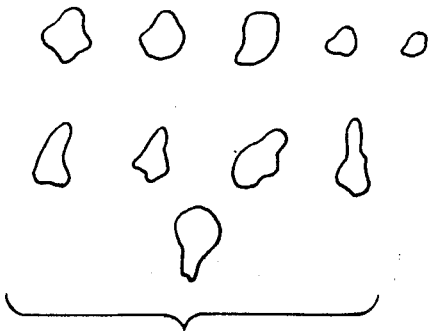
FIG. 2 shows a collection of typical distressing marks created by utilizing sodium particles weighing about 0.004 grams each.
Figure 3:
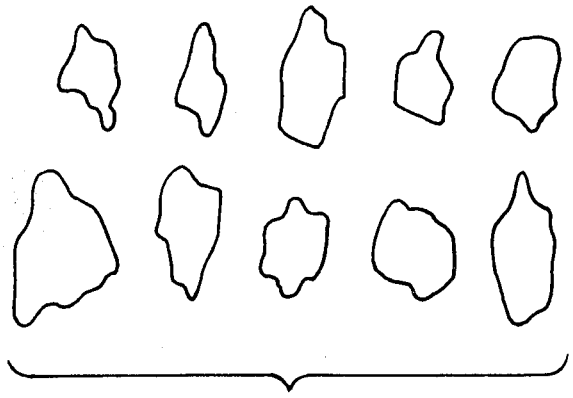
Figure 4:
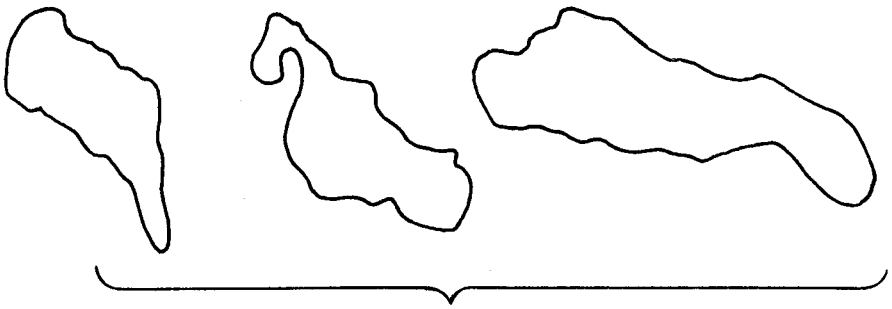

FIG. 3 is similar to FIG. 2 but showing distressing marks created by utilizing sodium particles weighing about 0.03 grams each; and FIG. 4 shows distressing marks of typical size and configuration obtained by utilizing about 10 to 15 closely disposed particles of sodium each weighing about 0.004 grams.

Figure 1:
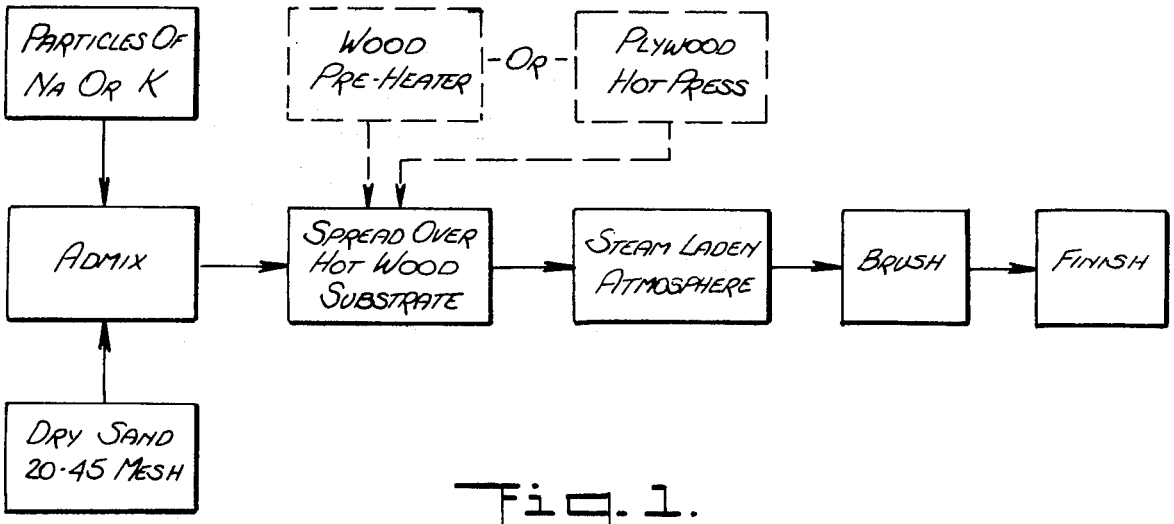
FIG. 1 is a flow diagram of the process in accordance with the subject invention.

Referring now to FIG. 1 of the drawings, the procedure in general terms in accordance with the present invention involves admixing paricles of sodium or potassium with dry sand having a grain size within the range of about 20 to 45 mesh. The admixture is spread over the wood substrate while the latter is at an elevated temperature and the assembly is then introduced into a steam laden atmosphere. When the sodium or potassium is exposed to the steam there is an immediate exothermic reaction between the metallic particles and the steam resulting in the liberation of hydrogen which in a matter of seconds ignites spontaneously resulting in first the melting and thereafter the burning of the sodium or potassium, as the case may be. The entire burning step is completed within seconds. The assembly is then removed from the steam laden atmosphere and subjected to brisk brushing to remove the burned residues, the sand and any loose charcoal from the wood surface. Thereafter the wood may be subjected to any appropriate finishing process.

To explain the process in greater detail, it is preferred that prior to spreading or distributing the metallic particles - sand mixture over the wood substrate, the wood substrate be pre-heated or otherwise brought to a temperature in the neighborhood of 200°F. or higher. The purpose of applying the metal particles and sand to a hot wood substrate is to prevent water vapor from condensing on the substrate when it is subsequently exposed to the steam laden atmosphere. An additional advantage of utilizing a hot wood substrate is that it can accelerate the subsequent burning reaction of the metallic particles.

Where the process is to be performed on plywood, the hot wood substrate may be the plywood panel as it is removed from the hot forming press in which the laminations are bonded together. However, if the present distressing process cannot be performed sufficiently close in time to the fabrication of the substrate, a pre-heating step must be performed to bring the substrate up to the preferred temperature. Of course, it will be understood that the wood substrate will not be heated to a temperature sufficiently high to cause charring of the content thereof.

The sodium or potassium particles are admixed with dry sand having a grain size of the order of 20 to 45 mesh for several reasons. The sand keeps the sodium or potassium particles or pieces from sticking together maintaining their respective individuality. The sand also keeps the sodium or potassium from running off the panel or wood substrate during the burning process. During the early stages of the exothermic reaction with the water vapor, the heat generated melts the sodium or potassium. The molten metal assumes a spherical shape due to its high surface tension. As the reaction becomes more vigorous the now molten metal spheres tend to roll about on the wood substrate. The sand helps to keep the molten metal in place.

The preferred grain size for the sand is as specified because if the sand is too coarse it will not serve the aforementioned purposes effectively. On the other hand, if the sand is too fine, it tends to cover the metallic particles and thus reduce the contact area between the particles and the steam atmosphere.

As presently preferred, the sand should be admixed with the metallic particles in approximately the ratio of 1:1 on a volume basis. If excessive sand is used, it will absorb excessive heat in the steam laden atmosphere and thus slow down the burning reaction.

The reaction step may be conducted within a suitable chamber. In the chamber, it is preferred that a temperature of not lower than about 50°C. and a relative humidity of not lower than about 80% be maintained. Where the particles are sodium, it is preferred that the temperature be maintained at about 90°C. and the relative humidity at about 100%.

In practicing the process, the metallic sodium or potassium admixed with the dry sand is spread preferably in a random fashion on the surface of the wood substrate. The distressing marks will then be distributed randomly over the wood surface. In order to afford a better understanding of the invention, several examples will now be described.

EXAMPLE 1

Lumps of metallic sodium were heated and melted in kerosine at about 98°C. The molten sodium metal was then beaten to small pieces with a stirrer while it was being poured into another container of kerosine at room temperature. The pieces of sodium metal so obtained were of different sizes and were then screened and separated into size groups and stored in kerosine or oil.

EXAMPLE 2

A ¼ inch thick chestnut plywood panel was first heated in an oven at 250° F. for three minutes. Particles of metallic sodium prepared as in Example 1 and weighing between 0.003 and 0.08 grams each were mixed in the ratio of about 1:1 on a volume basis with dry sand having a grain size between about 20 and 45 mesh. Said mixture was then spread randomly on the surface of the chestnut panel and the combination was then moved into a steam chamber wherein the atmosphere was maintained at a temperature of about 90° C. and a relative humidity of about 100%. Within an interval of about 20 seconds all of the sodium pieces reacted with the steam and burned. The panel was then removed from the steam chamber. Sand and the burned residues were brushed from the panel surface. Carbon stain surrounding the distress marks was removed from the panel surface by sanding. Attractive distressing marks of random shape and size were thus created on the panel surface.

EXAMPLE 3

A ¼ inch thick, 3-ply, plywood panel with walnut face, lauan core and elm back, was laminated with a urea-formaldehyde adhesive in a hot press at a temperature of about 250° F. When the panel was removed from the hot press a mixture of sodium particles and sand, prepared as described in Example 2, waa spread immediately on its surface. The panel with the material spread thereover was subsequently steamed, brushed and sanded as described in Example 2. Distressing marks were thus created on the panel surface.

EXAMPLE 4

The procedure set forth in Example 2 was repeated on a ¼ inch thick lauan plywood panel, a ¾ inch thick particleboard panel, a ⅜ inch thick Douglas fir plywood panel, and a 1 inch thick pine lumber board. Distressing marks were thus created on the surface of these wood substrates.

EXAMPLE 5

Lumps of metallic potassium were heated and melted in mineral oil at about 63° C. The molten potassium was then beaten to small pieces in the hot oil with a stirrer. The heat source was then removed. When the potassium pieces solidified, they were used as a substitute for the sodium pieces used in the preceding examples. The distressing marks obtained by burning potassium particles or pieces were comparable to those obtained by burning sodium.

The shape of the distressing marks that can be obtained through practice of the subject process is independent of the shape of the sodium or potassium particles employed. Regardless of the original shape of the metallic particles, they tend to melt and assume a spherical configuration before combustion takes place. However, the shape of the distressing mark created thereby is absolutely random. In FIG. 2, for example, there are shown various patterns that were obtained by burning sodium particles weighing about 0.004 grams each. In FIG. 3, there is shown the relative size and shape of marks obtained by burning sodium pieces weighing about 0.03 grams each.

Referring to FIG. 2, the 0.004 grams particles of sodium which were employed in the production of the distressing marks illustrated therein had a mean diameter somewhat slightly in excess of 3/16 inch. It will be understood that such dimension is a rough index since the particles have an irregular configuration and the dimension is presented merely to afford some point of reference in comparing the several examples. Thus, by way of comparison, the 0.03 grams particles used in producing the distressing marks shown in FIG. 3 have a mean diameter that averages slightly greater than ⅜ inch.

Larger distressing marks can be produced by concentrating a plurality of the metallic paricles within a small area. FIG. 4 illustrates distressing marks which were obtained by burning 10 to 15 closely placed sodium particles each weighing about 0.004 grams.

It should be understood that the sand removed from the surface of the wood substrate after the burning step may be collected, screened and reused.

It has been found that the wood substrate, because it is at an elevated temperature when introduced into the steam laden atmosphere, absorbs insufficient moisture to affect adversely subsequent finishing operations. Hence, subsequent finishing may be accomplished promptly after distressing the wood surface.

Having described the presently preferred embodiments of the invention, it will be readily understood by those skilled in the subject art that various changes in detail may be effected without departing from the true spirit of the invention as defined in the appended claims.

What is claimed is:

1. The method of distressing wood comprising the steps of admixing a quantity of particles selected from the group consisting of metallic sodium and metallic potassium with dry sand having a grain size of about 20 to 45 mesh, distributing said mixture over a surface of a wood substrate, introducing this wood substrate into a steam laden atmosphere, inducing spontaneous combustion in said particles in said steam laden atmosphere, and thereafter brushing said surface to remove burned residues and loose charcoal.

2. The method according to claim 1, wherein said sand is admixed with said metallic particles in the proportion of about 1:1 by volume.

3. The method according to claim 1, wherein said wood is caused to be at an elevated temperature before distributing said particles over its surface, and is introduced into said steam laden atmosphere, along with said particles distributed thereover, while at an elevated temperature sufficient to inhibit condensation of water on the surface thereof.

4. The method according to claim 3, wherein said grains of sand are admixed with said metallic particles in the proportion of about 1:1 by volume, and said steam laden atmospheres is at a temperature of about 90°C and said relative humidity is about 100%.

5. The method according to claim 1, wherein the step of inducing spontaneous combustion is carried out in the presence of water vapor at a temperature greater than about 50°C. but substantially below the char point of said wood.

6. The method according to claim 1, wherein the step of inducing spontaneous combustion is carried out in a steam laden atmosphere having a temperature above about 50°C. and a relative humidity above about 80%.

7. The method according to claim 1, wherein said temperature is about 90°C. and said relative humidity is about 100%.

8. The method according to claim 1, wherein said wood is caused to be at a temperature above about 200°F. before distributing said particles over its surface.

9. The method according to claim 1, wherein said particles are of sodium having a particle weight within the range of about 0.003 to 0.08 gms.

* * * * *